United States Patent [19]

Lilley

[11] Patent Number: 4,691,491

[45] Date of Patent: Sep. 8, 1987

[54] SUPPORT SYSTEMS

[75] Inventor: Raymond A. Lilley, Jordans, United Kingdom

[73] Assignee: Cladcolor Profiling Limited, Newport, United Kingdom

[21] Appl. No.: 841,285

[22] Filed: Mar. 19, 1986

[30] Foreign Application Priority Data

Mar. 20, 1985 [GB] United Kingdom ..... 8507191

[51] Int. Cl.[4] ..... E04B 5/52

[52] U.S. Cl. ..... 52/481; 52/508; 52/712

[58] Field of Search ..... 52/714, 721, 508, 712, 52/480, 481, 370, 369

[56] References Cited

U.S. PATENT DOCUMENTS

| | | | |
|---|---|---|---|
| 1,699,557 | 1/1929 | Yeager | 52/370 X |
| 2,013,101 | 9/1935 | Inglee | 52/370 X |
| 4,081,938 | 4/1978 | Bertacchi et al. | 52/714 X |
| 4,481,749 | 11/1984 | Stirling | 52/714 |

FOREIGN PATENT DOCUMENTS

| | | |
|---|---|---|
| 0119114 | 9/1984 | European Pat. Off. . |
| 1068676 | 5/1967 | United Kingdom . |
| 1134570 | 11/1968 | United Kingdom . |
| 2120702A | 12/1983 | United Kingdom . |
| 2134557A | 8/1984 | United Kingdom . |

*Primary Examiner*—Carl D. Friedman

*Attorney, Agent, or Firm*—Christie, Parker & Hale

[57] ABSTRACT

A roofing structure includes a plurality of beams supporting an inner skin of cladding material. The inner skin of cladding material is secured to the beams by U-shaped brackets. An inverted U-shaped rail nested with pairs of brackets is clamped to the brackets by means of a nut and bolt to define a box-like support structure.

An outer skin of cladding material is secured to the rails. Each bracket is provided with locating holes which can be engaged by a bolt and on which the rail can be nested to effect alignment between the fastening slots respectively in the bracket and the rail just prior to clamping.

7 Claims, 9 Drawing Figures

SUPPORT SYSTEMS

BACKGROUND OF THE INVENTION

1. Field of the Invention

The present invention relates to support systems for use for example with walls or roofs.

2. Description of the Prior Art

Walls and roofs for factory or warehouse buildings have been proposed consisting of a double skin of cladding material separated by a plurality of Z-shaped rails and with the space between the two skins filled with a thermally insulating material.

Such systems are difficult to fix and can readily be deformed when subjected to pressure or weight.

It is an object of the present invention to provide an improved support system.

SUMMARY OF THE INVENTION

According to the present invention there is provided a support system comprising a pair of U-shaped brackets arranged to be mounted in alignment with each other and a spanning rail of inverted U-shaped cross-section, one of said pair of brackets and said rail being nested one within the other, and means securing each bracket with the rail to provide a rigid composite structure of generally rectangular cross-section.

According to the present invention there is further provided a support system comprising a plurality of U-shaped brackets, each bracket having at least one opening in its base by means of which the bracket can be secured to a supporting structure, each bracket having a pair of aligned through holes, one hole in each side wall of the bracket, and a locating hole in each side wall located between the base and each through hole, each locating hole being spaced at a predetermined distance from its corresponding through hole; and a plurality of rails of inverted U-shaped configuration, one end of each rail being arranged to make nested engagement with a said bracket, each said end of the rail having a pair of aligned through holes, one hole in each side wall, each through hole being located at said predetermined distance from the free edge of the side wall whereby when a locating member is made to engage said aligned locating holes of the bracket and the free edges of the rail are rested on the locating member, the aligned through holes of the bracket will be in alignment with the aligned through holes of the rail to enable fastening means to be passed through the two pairs of aligned holes for fastening the rail to the bracket.

According to the present invention there is still further provided a support system comprising a pair of U-shaped brackets arranged to be mounted in alignment with each other, a spanning rail of inverted U-shaped cross-section, one of said pair of brackets and said rail being nested one within the other, and an inverted U-shaped clamp member for each bracket, each said clamp member being arranged to straddle said rail and to be secured to a corresponding bracket to provide a rigid composite structure of generally rectagular configuration.

Support systems for a roof embodying the present invention will now be described, by way of example, with reference to the accompanying diagrammatic drawings, in which:

DESCRIPTION OF THE PREFERRED EMBODIMENT

Figure 1:
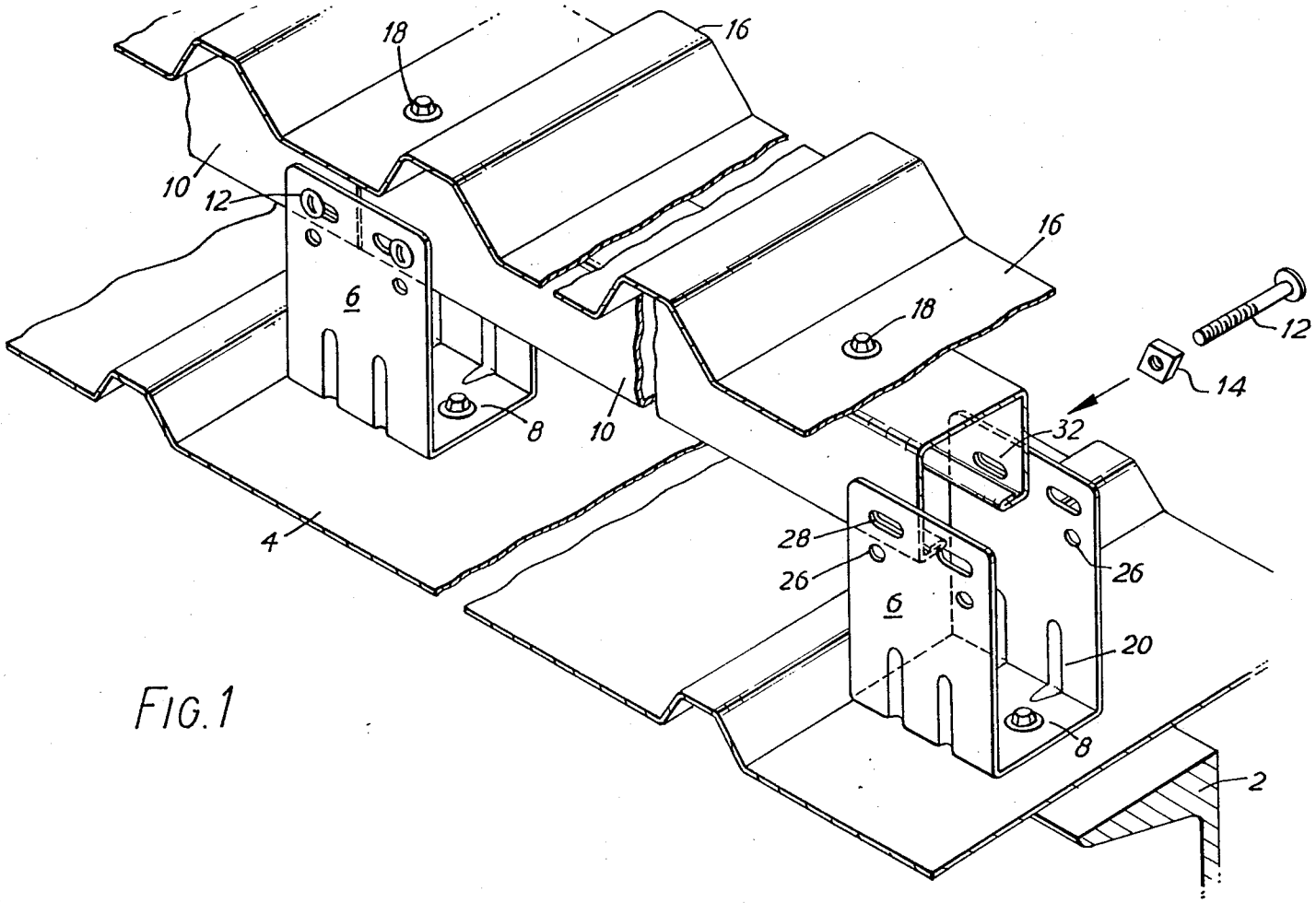
FIG. 1 is a perspectve view, part cut-away of the system.

The roofing system shown in FIG. 1 includes a pluralty of generally parallel beams 2 (only one shown) on which a plurality of sheets 4 of cladding are supported to form an inner skin. A plurality of U-shaped brackets 6 are mounted at regular intervals on the sheets 4 to extend in rows directly above the beams 2.

Each bracket is secured by fasteners 8 to the beam so that they are both rigidly secured to the beams 2 and clamp the sheets 4 against the beams 2.

The U-shaped brackets 6 in each row are aligned to receive a series of aligned rails 10. Each rail 10 is of inverted U-shaped cross-section and the end portion of each rail 10 is arranged to make nested engagement with a corresponding bracket 6.

The rails 10 are arranged to be secured to the U-shaped brackets by means of nuts 14 and bolts 12.

When all the rails 10 are secured in place they are located in parallel with the beams 2 but are held spaced above the beams 2 by the brackets.

A plurality of sheets of cladding 16 are secured to the rails 10 by fasteners 18 to form the outer skin of the roof.

The spacing between the inner and outer skins is advantageously filled with thermally insulating material.

The fasteners 8 and 18 preferably incorporate a washer or seal to prevent the ingress of water or water vapour to the space between the two skins.

Figure 2:
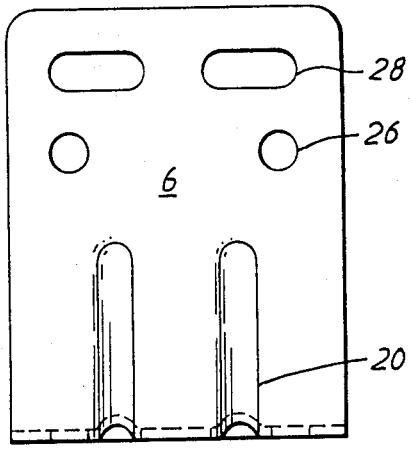
FIGS. 2 to 4 are respectively a front elevation, a side elevation and a plan view of one of the support brackets of the system of FIG. 1.
Figure 3:
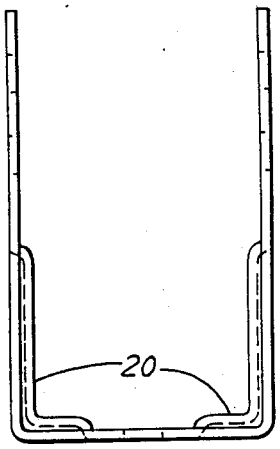
Figure 4:
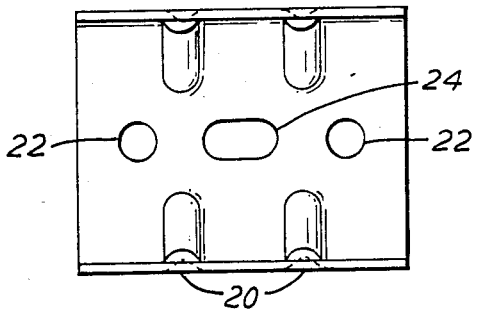

The construction of each bracket 6 can be seen more clearly from FIGS. 2, 3 and 4.

As shown a pair of L-shaped ribs 20 are formed on opposite sides of the brackets 6. These ribs 20 act to strengthen the bracket and to resist its deformation.

Figure 5:
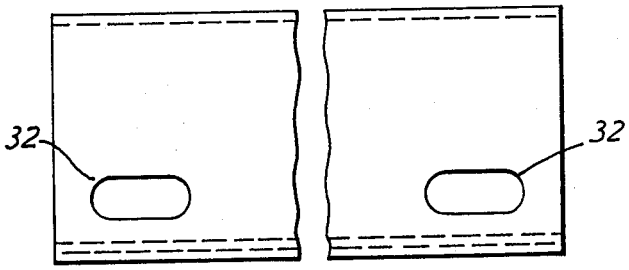
FIGS. 5 and 6 are respectively a front elevation and an end elevation of one of the support rails of the system of FIG. 1.
Figure 6:
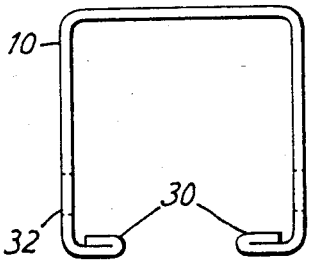

In the base of the bracket 6 there are provided a pair of through holes 22 located on opposite sides of a central slot 24 (see FIG. 4). Each side wall is provided with a pair of locating openings 26. A horizontally extending elongate slot 28 is provided a predetermined spacing above each locating opening 26. The construction of each rail 10 can be seen more clearly in FIGS. 5 and 6. As shown each rail is of generally inverted U-shaped configuration. The lower extremity of each side of the rail is folded over and bent inwardly to provide a pair of inwardly directed flanges 30.

In each side portion adjacent each end of the rail there is provided a horizontally extending slot 32.

The spacing between the lower extremity of the slot 32 and the underside of the flange 30 is arranged to be equal to the spacing between the lower extremity of the slot 28 in the bracket 6 and the upper extremity of the corresponding locating hole 26.

The actual assembly of the system will now be described in more detail.

Each row of brackets 6 is secured to a corresponding beam 2 with the centres of the brackets being spaced at regular intervals and with each interval corresponding to the length of a rail 10; the sheets 4 being located between the brackets 6 and the beam 2. A pad (not shown) of thermally insulating material, for example of plastics, is placed between each bracket and the beam to define a thermal break. A bolt 12 is passed through each pair of aligned locating openings 26 in each bracket. Each rail 10 which is intended to be supported between a pair of brackets is lowered with opposite ends in nesting engagement with respective brackets until the flanges 30 rest on respective bolts 12. In this position the slots 32 in the rail 10 will be level with the slots 28 in the bracket 6 and so additional bolts 12 and nuts 14 can be used to secure the rail 10 to the bracket 6 by passing the bolt 12 in question through the aligned pairs of slots 28 and 32 and securing the nut to the bolt. The bolts 12 in the locating holes 26 now that their task is completed can now be removed.

In this manner all the rails can be secured to the brackets 6 to provide an array of rails for supporting the cladding which will define the outer skin of the building.

It will be appreciated that the combination of each rail 10 with each bracket defines a box like structure which provides a rigid and sturdy support for the outer skin of the building.

The inverted U-shaped rail nested within the U-shaped bracket provides a means by which the two components can be located and their relative positions adjusted just prior to clamping.

Instead of the locating action being achieved by the bolt 12 passing through openings 26, the openings 26 can be omitted and the walls of the brackets 6 deformed to form inwardly projecting dimples or cut and then deformed to define inwardly projecting lands. In this way the rail could be made to rest on the dimples or lands so that the aligned slots 28 and 32 would be in the same horizontal plane.

In a modification the two inwardly extending flanges 30 of the rail can be replaced by outwardly extending flanges and the rail 10 made slightly wider so that the bracket 6 can be nested within the rail 10.

Advantageously the brackets 6 and the rails 10 are steel or aluminium.

When supplied in kit form the rails can be supplied in a plurality of different lengths to provide different spans as required.

Where greater spacing between inner and outer skins is required than can be provided by the bracket 6, an auxiliary inverted U-shaped member (not shown) may be used. The bracket is then bolted on to the top of this auxiliary inverted U-shaped member and the auxiliary U-shaped member is provided with outwardly directed feet which in turn are bolted to the beam 2. Instead of the feet being bolted, a single bolt can be used to bolt both the inverted U-shaped member and the bracket to the beam 2. In this way the spacing between the skins can be increased by the height of the auxiliary inverted U-shaped member.

Figure 7:
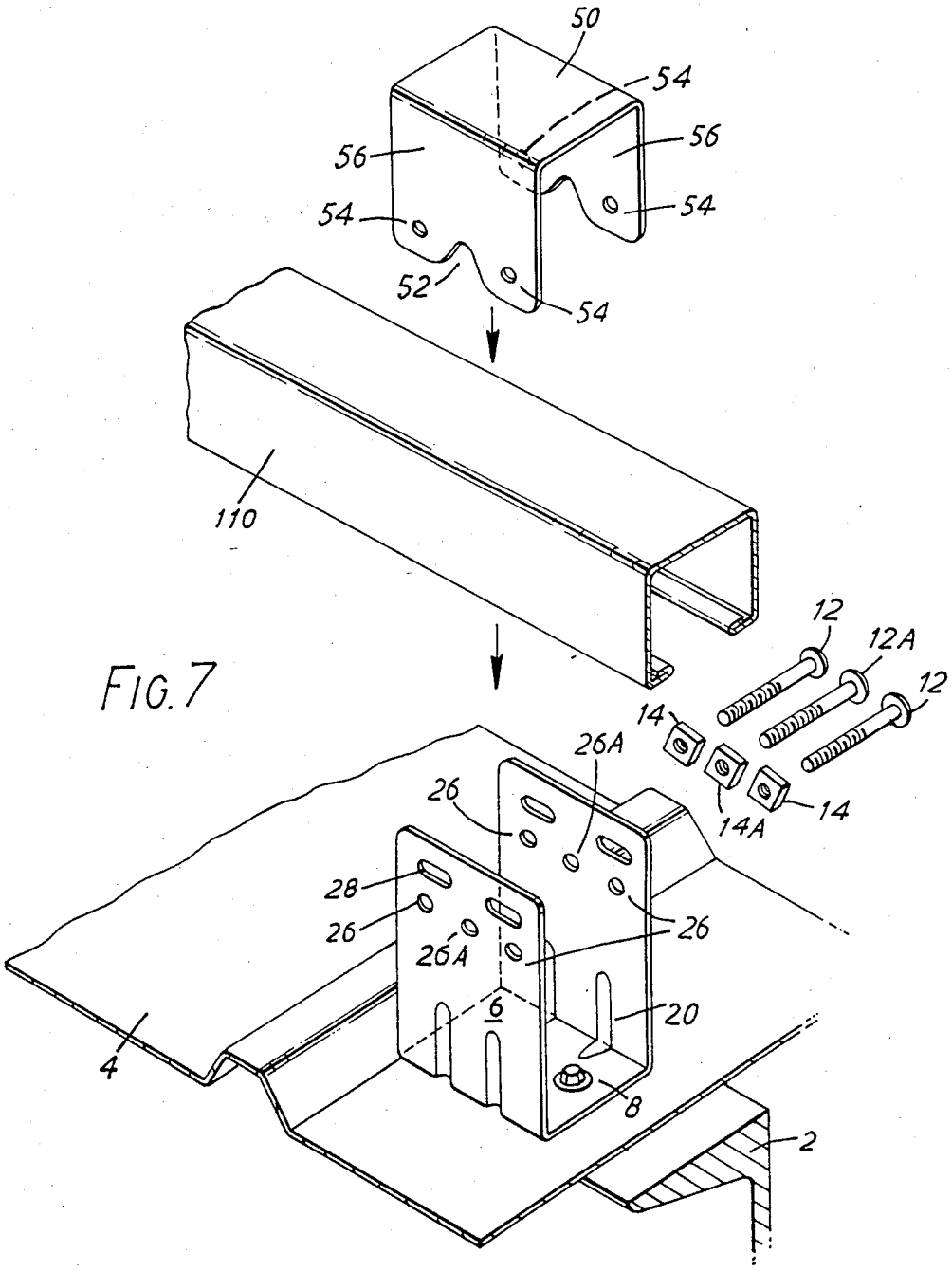
FIG. 7 is an exploded perspective view of a modified system.
Figure 8:
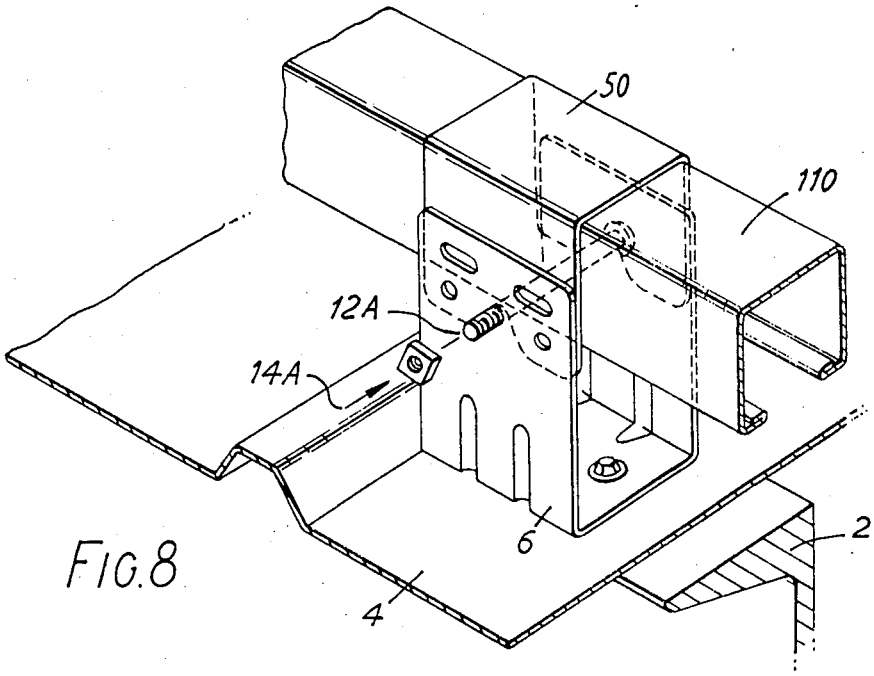
FIGS. 8 and 9 are perspective views of the system of FIG. 7 during different stages of assembly.
Figure 9:
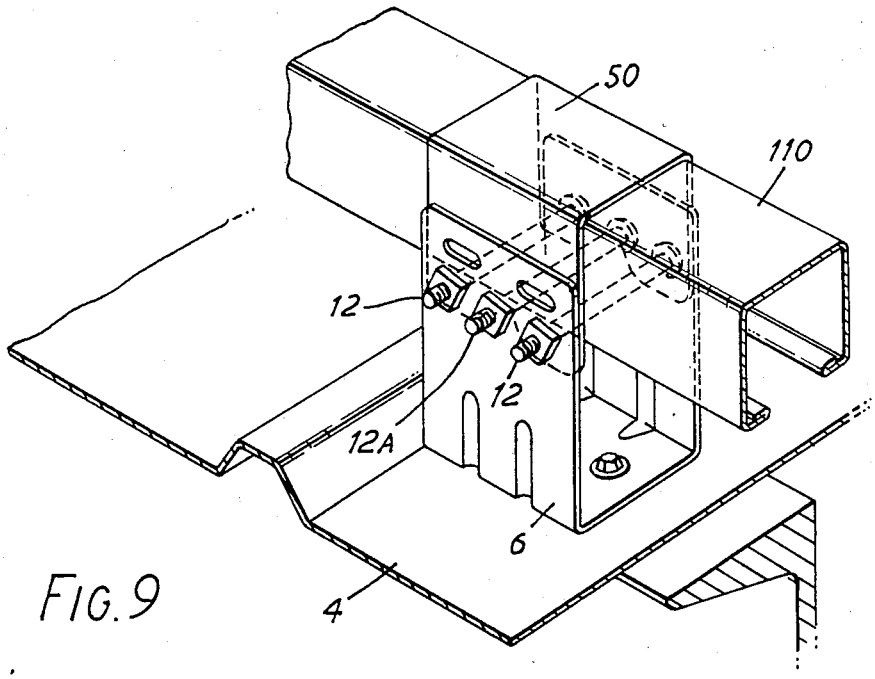

In the roofing system shown in FIGS. 7 to 9 parts similar to the system of FIGS. 1 to 6 are similarly referenced.

As shown the system includes a plurality of parallel beams 2 (only one shown) on which a plurality of sheets 4 of the cladding are supported to form an inner skin. A plurality of U-shaped brackets 6 are mounted at regular intervals on the sheet 4 to extend in rows directly above the beams 2.

Each bracket is secured by fasteners 8 to the beam to both rigidly clamp the sheet 4 and bracket 6 against the beam 2. The U-shaped bracket 6 is similar to that described in conjunction with FIG. 1 except that a third locating hole 26A is provided in each side wall between the existing two holes 26.

The U-shaped brackets in each row are aligned to receive a series of rails 110. Each rail 110 is similar to the rail 10 of FIG. 1 except that the horizontally extending end slots are omitted. In order to secure the rail to the bracket 6 an inverted U-shaped clamp member 50 is provided. As shown the clamp member 50 has a pair of spaced downwardly depending arms 56. The spacing between the arms 56 is such as to accommodate the rail 110 and also be accommodated between the arms of the bracket 6. The lower portion of each arm 56 has a generally inverted V-shaped recess 52 flanked on each side by an opening 54. The upper extremity of the recess 52 and the two openings lie along a common line and are spaced from one another by the same distances as that by which the three holes 26, 26A and 26 in each arm of the bracket 6 are spaced. In a preferred form the upper extremity of the recess lies fractionally above the common line.

To assemble system, a bolt 12A is fed through the pair of aligned holes 26A and 26A in the bracket and a corresponding nut 14A is loosely screw threadedly fastened to the free end of the bolt 12A. The rail 110 is then lowered between the arms of the bracket 6 until it rests on the bolt 12A. The rail 110 can then be adjusted longitudinally as required. The inverted clamp member 50 is then placed over the rail 110 at the point where the rail passes through the bracket 6 and lowered so that its arms 56 pass between the rail 110 and the side wall of the bracket 6 until the bolt 12A is engaged by the recesses 52. If the apex of each inverted V-shaped recess does not lie vertically above the bolt 12A then downward pressure applied to the clamp member 50 will produce a cam action between each recess 52 and the bolt 12A to shift the clamp member 50 longitudinally of the rail 110 until the bolt 12A becomes lodged in the apex. This action ensures perfect alignment between the openings 54 in the clamp member 50 and the holes 26 in the bracket 6. (see FIG. 8).

This now allows the bolts 12 to be passed through the mating holes 26 and openings 54. Finally the application of the nuts 14 to the free ends of the bolts and the tightening of the nuts 14 and 14A (see FIG. 9) will effect a clamping action to clamp the rail 110 to the bracket 6.

The rail 110 is thus imprisoned between the bracket 6 and its co-operating clamp member 50.

Although sliding of the rail 110 along its longitudinal axis is resisted by the friction which exists between the clamp member 50 and the rail 110, additional security against such sliding can be provided by drilling an opening in the co-operating roofs of the clamp member 50 and rail 110 and fixing a nut and bolt or other fastening means therethrough.

With this form of support system it will be appreciated that the rails do not need to be supplied in specific discrete lengths but can be cut to size from longer lengths as required.

With this arrangement it will be appreciated that at least the bolt 12A carries the burden consisting of the weight of the rail and any load it may have to bear, while the two bolts 12 and 12 will act to resist the burden of upward forces applied to the rail, for example by wind.

Preferably the clamp member 50 is dimensioned to be a tight fit between the bracket 6 and the rail 110. In particular the action of the clamp member 50 upon insertion between the bracket 6 and the rail 110 should be to spring the walls of the bracket 6 slightly apart. In this way the walls of the bracket 6 will be biassed inwardly against the clamp member 50 and the walls of the rail 110 will be biassed outwardly against the clamp member 50.

While a presently preferred embodiment of the present invention has been illustrated and described, modifications and variations thereof will be apparent to those skilled in the art given the teachings herein, and it is intended that all such modifications and variations be encompassed within the scope of the appended claims.

I claim:

1. A support system comprising:

a pair of U-shaped brackets arranged to be mounted in alignment with each other, and each having rail locating means;

a spanning rail of inverted U-shaped cross-section each of said pair of brackets and said rail being nested one within the other with the rail resting on the locating means of each bracket; and an inverted U-shaped clamp member for each bracket, each said clamp member being arranged to straddle said rail and to be secured to a corresponding bracket to provide a rigid composite structure of generally rectangular configuration and each said clamp member defining a profiled recess arranged to engage said locating means and by cam action effecting displacement of the clamp member with respect to the bracket to bring the clamp member into a predetermined position with respect to said bracket.

2. A system according to claim 1 wherein said clamp member has:

a pair of downwardly depending arms arranged to lie between the rail and corresponding ones of the two arms of the bracket and to extend below the lower extremity of the rail, and including:

fastening means for fastening the clamp member to the bracket at a location below the rail to constrain the rail against vertical movement with respect to the bracket.

3. A system according to claim 2 wherein said recess is of inverted V-shaped configuration.

4. A system according to claim 3 wherein said recess defines an apex which is flanked by aligned openings defined by said clamp member, said openings and the apex of the recess being aligned with corresponding openings in the bracket when the clamp member is in said predetermined postion, to enable fastening means to engage said aligned openings and thereby lock the bracket to the clamp member.

5. A system according to claim 1 wherein each bracket includes strengthening ribs to resist deformation from its U-shaped configuration.

6. A roof or wall structure including a support system according to claim 1 supported on an inner skin of cladding material and supporting an outer skin of cladding material spaced from the inner skin by a predetermined spacing.

7. A roof or wall structure according to claim 6 including thermal insulation filling the space between the inner and outer skins.

* * * * *